United States Patent [19]

Shebley

[11] 4,358,013

[45] Nov. 9, 1982

[54] MEDITATION SUPPORTING DEVICE

[76] Inventor: David P. Shebley, 1842 Woodsdale Ct., Concord, Calif. 94521

[21] Appl. No.: 172,981

[22] Filed: Jul. 28, 1980

[51] Int. Cl.[3] ..... B65D 25/54; B65D 85/00

[52] U.S. Cl. ..... 206/45.34; 206/232; 206/526

[58] Field of Search ..... 206/526, 232, 45.34; 221/265; 194/3; 40/19; 220/4 B

[56] References Cited

U.S. PATENT DOCUMENTS

| | | | |
|---|---|---|---|
| 385,106 | 6/1888 | Fitch . | |
| 481,448 | 8/1892 | Weeks . | |
| 649,075 | 5/1900 | Schreiber . | |
| 893,174 | 7/1908 | Lacy | 273/139 |
| 1,644,150 | 10/1927 | Reynolds . | |
| 1,856,619 | 5/1932 | Carsey | 206/232 |
| 2,420,265 | 5/1947 | Schick | 40/19 |
| 2,447,844 | 8/1948 | Cutter . | |
| 2,677,901 | 5/1954 | Tilleman . | |
| 2,858,955 | 11/1958 | Kroenert | 220/4 B |
| 2,880,906 | 4/1959 | Probasco | 221/265 |
| 2,954,628 | 10/1960 | Baldwin et al. . | |
| 2,998,896 | 9/1961 | Miller | 220/4 B |
| 3,306,266 | 2/1967 | McCunney . | |
| 3,561,579 | 2/1971 | Allison | 194/3 |

*Primary Examiner*—William T. Dixson, Jr.

*Attorney, Agent, or Firm*—Fitch, Even, Tabin, Flannery & Welsh

[57] ABSTRACT

A meditation supporting device is disclosed including a variety of religious or inspirational messages as indicia upon scrolls which are separately inserted into capsule-like containers, a plurality of the capsule-like containers, with a variety of the messages, being disposed within a large display container for selective removal therefrom to permit extraction of their individual message-containing scrolls for the purpose of assisting in or promoting religious or inspirational meditation, discussion or the like.

6 Claims, 3 Drawing Figures

FIG. 1
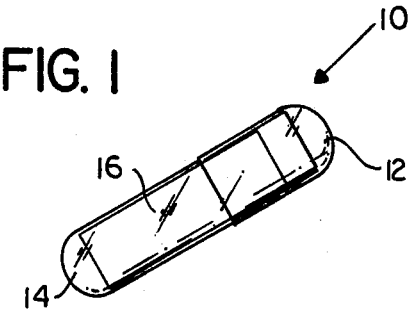
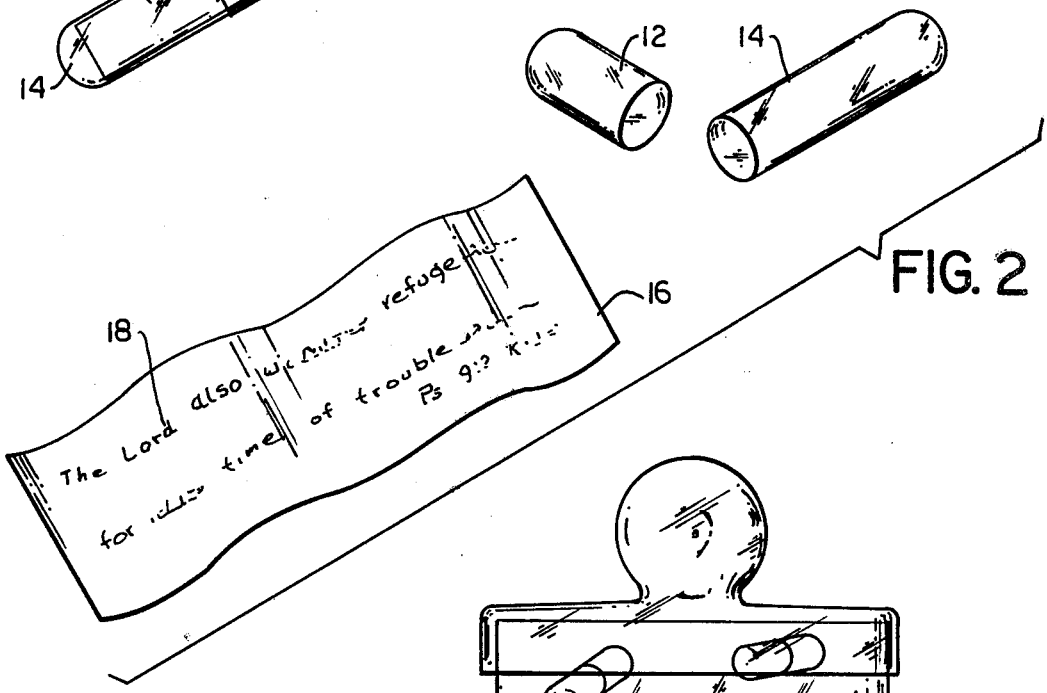
FIG. 2
FIG. 3
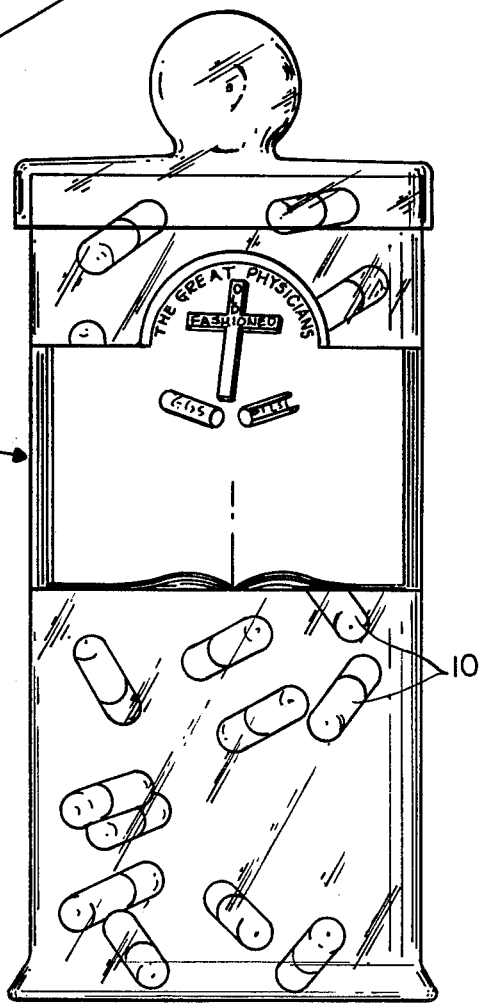

MEDITATION SUPPORTING DEVICE

The present invention relates to a device intended for religious or inspirational purposes to provide guidelines or support in meditation and more particularly to such a device including a variety of inspirational or religious messages, packaging for the device indicating a correlation for the inspirational or religious messages with medication of the type contemplated for maintaining physical health.

Accordingly, it is a particular object of the invention to provide such a device which may be employed by religious, inspirational or meditation groups or even by individuals. More specifically, it is an object of the invention to provide such a device wherein a variety of inspirational or religious messages are imprinted on scrolls, the scrolls being inserted into capsules of the type contemplated for use with physical medication. Preferably, a relatively large number of the capsules including a variety of the messages are inserted into a container which may preferably be in the form of an apothecary jar or even in the form of a large capsule of sufficient volume for maintaining a large number of the individual capsules containing the various messages.

The placement of the individual messages within capsules and the use of an apothecary jar, or even a large capsule, for containing the smaller capsules including the variety of messages is intended to demonstrate the value of the messages for spiritual purposes in much the same manner that such capsules are normally employed to contain medication for maintaining or improving physical health.

It is also particularly contemplated that a large number of the capsules containing a variety of religious or inspirational messages may be sold in a display container such as the apothecary jar or large capsule while replacement supplies of the capsules themselves may possibly be sold in a relatively simple container from which the capsules may be transferred into the original display container. Accordingly, the term "container" as employed within the present application is intended to encompass both the original display container for the capsules as well as any container including a replacement supply thereof.

The device of the present invention, including a large number of capsules with a variety of religious or inspirational messages, may be used for religious, inspirational or meditation groups or even by individuals. Sets of the capsules in suitable display containers may, for example, be sold for promotional or fund raising purposes by groups such as churches, parochial schools, auxiliary groups and the like. After such initial sale, it is contemplated that groups such as classes or seminars and even individuals may use the device for example by selecting one of the capsules at random on a periodical or daily basis. The message found within the capsule may then form the basis for meditation or discussion at that particular time. However, other types of uses will also be apparent from the following description. For example, it is also contemplated that different capsules might even be selected by different individuals within a given group in order to provide a variety of subjects for further meditation or discussion.

Additional objects and advantages of the invention will be made apparent in the following description having reference to the accompanying drawings.

In the drawings:

FIG. 1 is a representation of a single capsule containing a scroll upon which a religious or inspirational message is imprinted.

FIG. 2 is a view of the scroll in a condition removed from the capsule and unrolled to better demonstrate the message imprinted thereupon.

FIG. 3 is a view of a large container, preferably an apothecary jar, containing a relatively large number of the smaller individual capsules with a variety of such religious or inspirational messages.

Referring now to the drawings, the present invention is directed toward a meditation supporting device including a large number of individual capsules such as that indicated at 10 in FIG. 1. The capsule 10 is of a conventional type formed from two sections 12 and 14 each of cylindrical construction and being enclosed at one end, one of the capsules sections being slightly smaller than the other in order to permit it to be inserted within the other section to form the complete capsule 10. The capsule 10 may be formed of gelatin material of the type commonly employed for containing medication and the like. At the same time, it will also be apparent that the capsule may be formed by other suitable materials such as plastics, etc. In any event, the capsules are preferably formed from a transparent material so that the scroll contained within the capsule will be visible therethrough.

A scroll of the type contemplated for arrangement within the individual capsules is indicated at 16 and includes indicia 18 in the form of a religious or inspirational message. Preferably, the message 18 may be a selected scriptural verse. However, it will be readily apparent that different types of religious or inspirational messages could be imprinted upon the scrolls for the purpose contemplated by the present invention.

The size of the capsule 10 as well as the size of the scroll 16 is clearly a matter of choice within the scope of the present invention. In order to assure that the scroll is of sufficient size to permit it to be read with relative ease, the capsules are preferably of a conventional configuration having a length of approximately one inch, the scrolls being formed from sheets of paper, film or the like having a width of approximately three-fourths inches and a length of approximately three to four inches. The paper or film may then be rolled about its short dimension or width in order to form the scroll 16 for insertion into the capsule.

Referring now to FIG. 3, a relatively large container 20 is preferably configured as an apothecary jar in order to contain a large number of the individual capsules 10. The configuration of the large container 20 as an apothecary jar is again intended to demonstrate the connection between the use of the inspirational messages and the taking of medication or the like on a regular periodical basis. Preferably, the individual capsules 10 arranged within the large container 20 are selected to include a variety of different religious or inspirational messages. For example, the different capsules may contain individual scrolls 16 which have different scriptural passages imprinted thereupon.

It is further contemplated that the capsules may be of selected color for one purpose or another. Initially, it is contemplated that each combination of capsules for filling one of the large containers 20 will be of a uniform color while containing a variety of different messages. In this manner, replacement sets of capsules for insertion into the container may be of different colors in order, for example, to assure that different varieties of messages are made available within the single display container 20. On the other hand, it is also possible that different colors may be employed for the individual capsules in correlation with the specific individual message contained within each capsule. In this manner, a variety of colors of capsules would be present within the particular container 20.

Additional modifications and variations of the device of the present invention are believed to be apparent from the preceding description. For example, other display containers in addition to the apothecary jar 20 are believed apparent within the scope of the invention. For example, a large capsule generally of the same size as the container 20 but of the same configuration as the individual capsules 10 could be employed in place of the display container 20. Similarly, other configurations would be possible for the individual capsules or scroll containers 10. Accordingly, the scope of the present invention is defined only by the following appended claims.

What is claimed is:

1. A meditation support device comprising a plurality of capsule-like containers, individual scrolls containing indicia in the form of a variety of inspirational messages being disposed within the capsule-like containers, the plurality of capsules including the scrolls with the variety of inspirational messages being disposed within a relatively large display container in order to permit selective removal of the capsules and extraction of the scrolls therefrom for displaying the individual inspirational message, the capsule-like containers and the display container being of configurations associated with medicine and/or physical medications.

2. The device of claim 1 wherein the inspirational messages are in the form of scriptural text.

3. The device of claim 1 wherein the capsule-like containers are formed from tubular sections each closed at one end, one section being smaller than the other to permit its insertion thereinto for containing one of the scrolls.

4. The device of claim 1 wherein the capsule-like containers are color-coded.

5. The device of claim 1 wherein the display container is an apothecary-type jar.

6. The device of claim 1 wherein the capsule-like containers and the display container are each formed from two sections of tubular configuration closed at one end and being nestable together for containing the scrolls within the capsule-like containers and for containing a plurality of the capsule-like containers within the display container.

* * * * *